US010814370B2

(12) United States Patent
Zhang et al.

(10) Patent No.: US 10,814,370 B2
(45) Date of Patent: Oct. 27, 2020

(54) SPECIAL-PURPOSE DIE FOR SHAPING ALUMINUM-MAGNESIUM ALLOY BY ROTATING EXTRUSION

(71) Applicant: North University of China, Taiyuan, Shanxi (CN)

(72) Inventors: Zhimin Zhang, Shanxi (CN); Jianmin Yu, Shanxi (CN); Qiang Wang, Shanxi (CN); Mo Meng, Shanxi (CN); Jian Xu, Shanxi (CN); Bing Bai, Shanxi (CN)

(73) Assignee: North University of China, Taiyuan (CN)

( * ) Notice: Subject to any disclaimer, the term of this patent is extended or adjusted under 35 U.S.C. 154(b) by 298 days.

(21) Appl. No.: 15/947,972

(22) Filed: Apr. 9, 2018

(65) Prior Publication Data

US 2018/0369889 A1 Dec. 27, 2018

(30) Foreign Application Priority Data

Jun. 27, 2017 (CN) ..... 2017 1 0544673

(51) Int. Cl.

| | |
|---|---|
| ***B21C 25/02*** | (2006.01) |
| ***B21C 29/04*** | (2006.01) |
| ***B21C 23/00*** | (2006.01) |
| ***B21C 29/00*** | (2006.01) |
| ***B21C 23/08*** | (2006.01) |
| ***B21C 25/04*** | (2006.01) |
| ***B21C 23/20*** | (2006.01) |

(52) U.S. Cl.

CPC ..... *B21C 25/025* (2013.01); *B21C 23/002* (2013.01); *B21C 23/005* (2013.01); *B21C 23/085* (2013.01); *B21C 23/205* (2013.01); *B21C 25/02* (2013.01); *B21C 25/04* (2013.01); *B21C 29/003* (2013.01); *B21C 29/04* (2013.01)

(58) Field of Classification Search

CPC ..... B21C 25/02; B21C 25/04; B21C 23/085; B21C 23/205; B21C 29/04; B21C 29/003; B21C 23/04; B21C 23/08; B21C 23/212; B21C 23/002; B21C 25/08

See application file for complete search history.

(56) References Cited

U.S. PATENT DOCUMENTS

| | | | | |
|---|---|---|---|---|
| 6,219,914 | B1 * | 4/2001 | Nickel | B21C 23/205 29/527.2 |
| 10,265,746 | B2 * | 4/2019 | Zhang | B21C 23/085 |
| 10,265,747 | B2 * | 4/2019 | Yu | B21C 25/02 |
| 2018/0056351 | A1 * | 3/2018 | Zhang | B21C 23/20 |
| 2018/0056353 | A1 * | 3/2018 | Yu | B21C 25/02 |
| 2018/0369888 | A1 * | 12/2018 | Wang | B21C 23/14 |

* cited by examiner

*Primary Examiner* — Debra M Sullivan

(74) *Attorney, Agent, or Firm* — Berggren LLP

(57) ABSTRACT

A special-purpose die for shaping an aluminum-magnesium alloy by rotating extrusion is provided, including a male die and a female die, wherein a trapezoidally-sectioned groove is formed at an end portion of a working area of the male die, an inner portion of the male die is hollow, with the hollow inner portion having sections of equal area, a circumferential wall of a die cavity of the female die is provided with at least two symmetrical axial grooves, and a cavity is formed inside a clamping part of the female die. The present disclosure remarkably reduces the axial extrusion force such that the deformation of the formed workpiece is more uniform, which greatly improves the mechanical property of the formed workpiece.

5 Claims, 10 Drawing Sheets

SPECIAL-PURPOSE DIE FOR SHAPING ALUMINUM-MAGNESIUM ALLOY BY ROTATING EXTRUSION

CROSS-REFERENCE TO RELATED APPLICATIONS

This application claims priority to Chinese Patent Application No. 201710544673.7, filed on Jun. 27, 2017 with the State Intellectual Property Office (SIPO) of the People's Republic of China and entitled "Special-purpose die for Shaping Aluminum-magnesium Alloy by Rotating Extrusion", the contents of which are herein incorporated by reference in their entirety.

TECHNICAL FIELD

The present disclosure relates to the field of severe plastic deformation of aluminum-magnesium alloys, and particularly to a special-purpose die for shaping (forming) of an aluminum-magnesium alloy by rotating extrusion.

BACKGROUND ART

Extrusion is a precise forming method which is relatively preferable in plastic forming. Traditional extrusion refers to a pressure processing method of pressurizing a blank in a die cavity of a female die by a punch, to incur volume transfer of the material so as to obtain a workpiece corresponding to the die cavity. During extrusion, the blank is in a three-dimensional compressive stress state, and in such a state, plasticity of the material can by fully exerted, and for the blanks which do not have very good plasticity and are not easy to process, a relatively good shaping effect can also be achieved by extrusion forming. However, for the materials with low plasticity, even when they are subjected to extrusion forming, the finally-formed workpiece has a relatively low mechanical property, and even can hardly meet the technical requirements due to non-uniform local deformation. Non-uniform deformation generated during extrusion mainly results from: (1) frictional force existing between the deformed metal and the die; (2) inconsistent flow resistances of parts of the metal; (3) non-uniform structure of the deformed metal; and (4) unreasonable shape and size of the working part of the die. Due to these factors, the extruded metal has strong anisotropy, which greatly restricts the development of the extrusion-forming technology.

Currently, the rotating extrusion method is used. The technology of shaping by rotating extrusion is a novel extrusion method in which a torque is applied on the basis of the traditional extrusion. In the forming process, the male die or the female die is made to rotate to produce, by changing the internal stress-strain state of a deformed body, a relatively large amount of shear strain, which can refine the grains to form a fine grain structure with a large-angle grain boundary, ensuring the uniform structure of the extrusion-formed component and reducing anisotropy of the properties of the formed component. Such loading manner may enable the deformed body to be axially compressed on one hand, and on the other hand, the torque may cause a tangential shear strain deformation. Rotating extrusion is a combined loading deformation technology, which effectively controls the contact friction and makes the same become beneficial by applying a combined strong shear stress field to the deformed body, so as to achieve the object of greatly changing the internal stress state of the material and improving the traditional pressure processing technology.

SUMMARY

The present disclosure provides a special-purpose die for shaping an aluminum-magnesium alloy by rotating extrusion, which remarkably reduces the axial extrusion force such that the deformation of the formed workpiece is more uniform, and improves the mechanical property of the formed workpiece.

In order to achieve the above object, the following technical solution is used in the present disclosure:

a special-purpose die for shaping an aluminum-magnesium alloy by rotating extrusion, comprising a male die and a female die, wherein a trapezoidally-sectioned groove is formed at an end portion of a working area of the male die, an inner portion of the male die is hollow, with the hollow inner portion having sections of equal area, a circumferential wall of a die cavity of the female die is provided with at least two symmetrical axial grooves, and a cavity is formed inside a clamping part of the female die.

A female die electric heater is placed in the cavity inside the clamping part of the female die.

A bottom of the die cavity of the female die has a part, where a blank is placed, with the part formed in a form of an insert, and an inner hole is formed in the middle of the insert for allowing thermocouple wires to be welded, and the thermocouple wires, together with the insert, are then placed at the bottom of the die cavity of the female die.

The circumferential wall of the die cavity of the female die is provided with six symmetrical axial grooves.

A male die electric heater is placed in the hollow inner portion of the male die.

In the present disclosure, by forming a trapezoidally-sectioned groove at the end portion of the working area of the male die, a torque is formed for the entire metal during the extrusion forming by using the metal in the trapezoidally-sectioned groove, and by providing symmetrical axial grooves in the circumferential wall of the die cavity of the female die to make the metal blank flowing into the axial grooves in the extrusion forming process synchronously rotate with the female die and by simultaneously heating the male die and the female die, heating of the extruded workpiece tends to be uniform. In addition, in the present disclosure, by rotation of the female die and due to the guiding effect of the axial grooves on the metal blank in the axial grooves to a certain extent, the axial loading force on the blank is significantly reduced, which can reduce the forming load and equipment tonnage, thereby achieving the object of "doing great work with small devices".

DETAILED DESCRIPTION OF EMBODIMENTS

Below, the present disclosure is further described in connection with the embodiments with reference to the figures.

Figure 1:
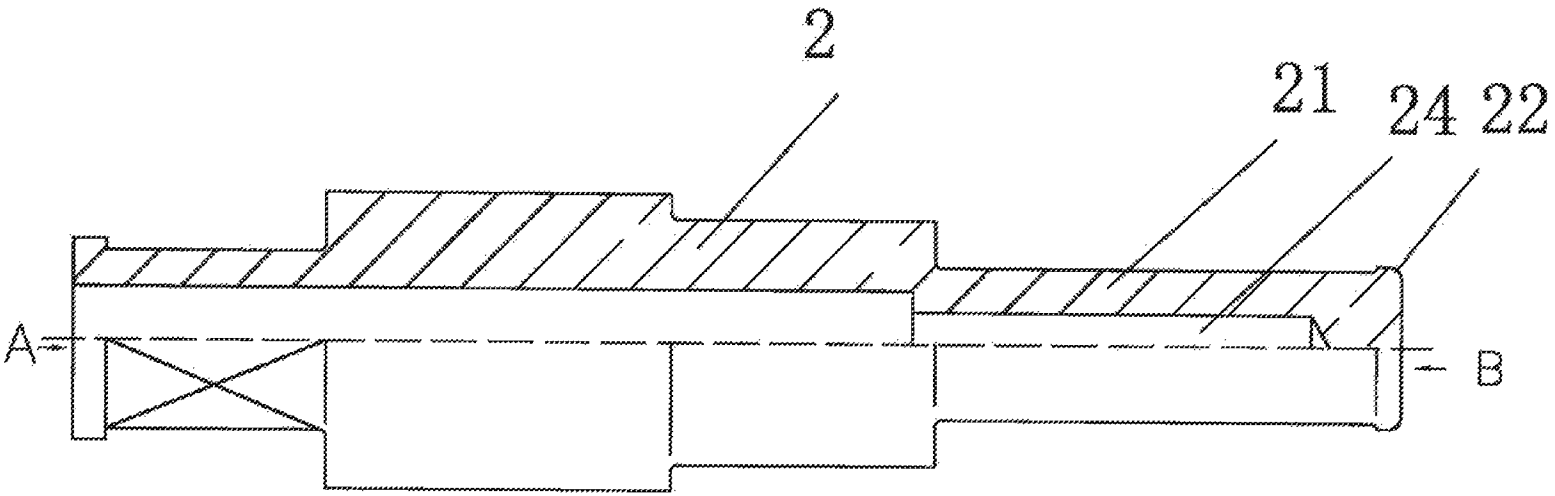
FIG. 1 is a sectional view of a male die of the present disclosure.
Figure 2:
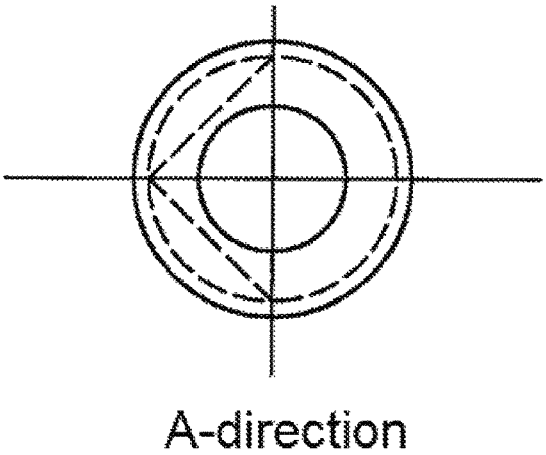
FIG. 2 is an A-directional view of FIG. 1.
Figure 3:
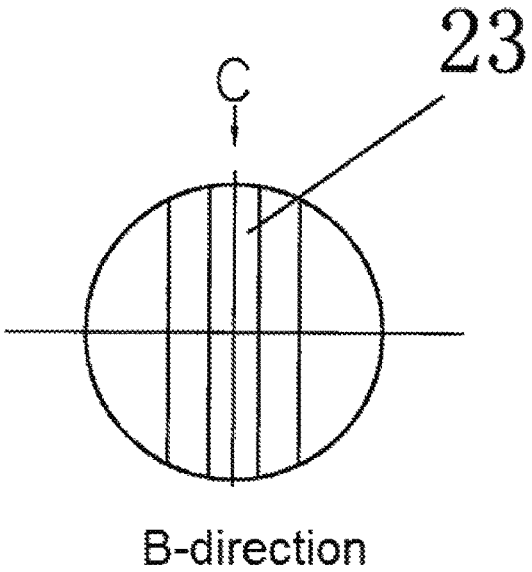
FIG. 3 is a B-directional view of FIG. 1.
Figure 4:
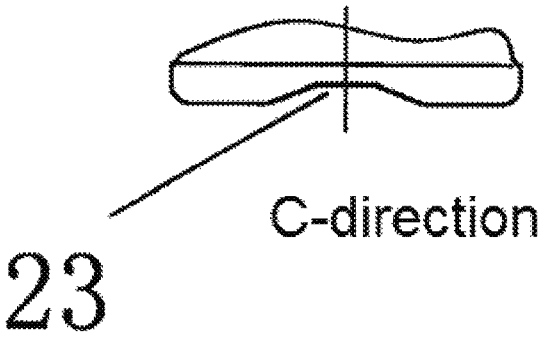
FIG. 4 is a C-directional view of FIG. 3.
Figure 5:
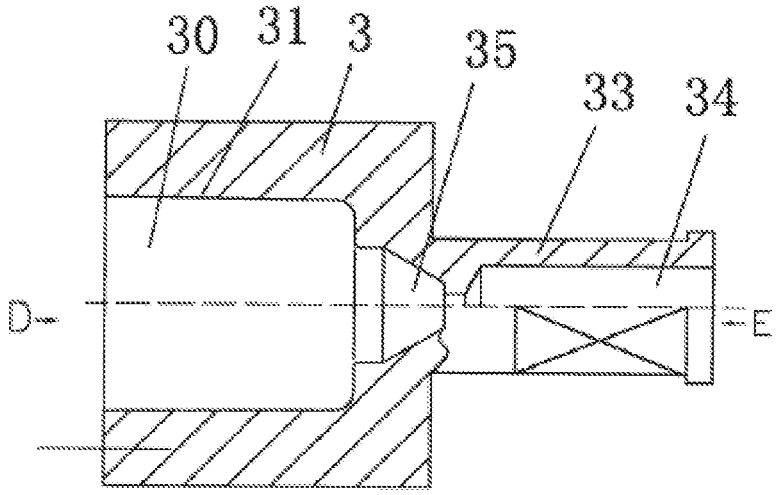
FIG. 5 is a sectional view of a female die of the present disclosure.
Figure 6:
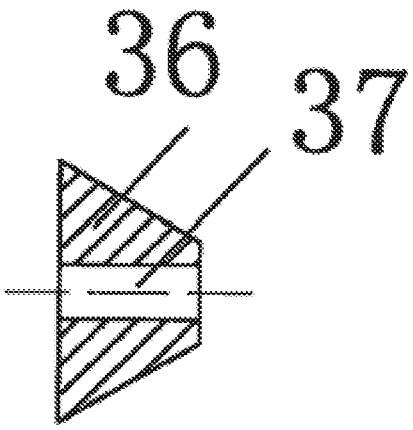
FIG. 6 is a sectional view of an insert of the female die of the present disclosure.
Figure 7:
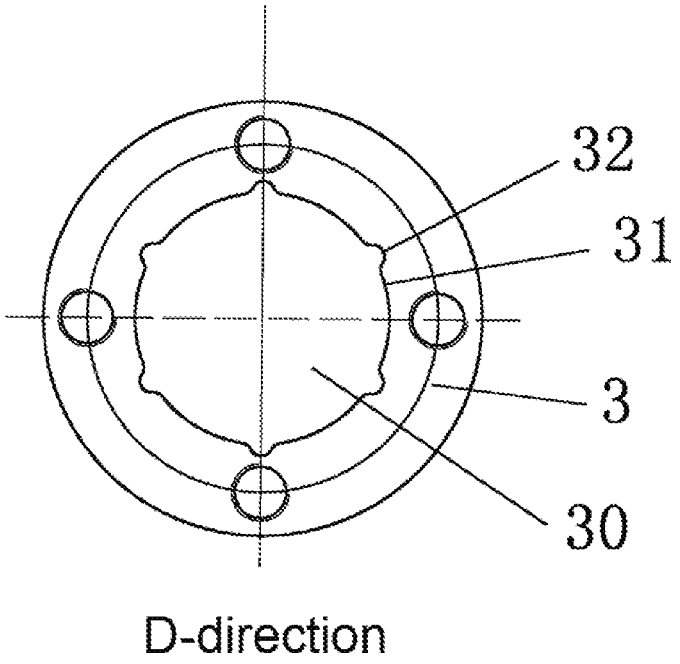
FIG. 7 is a D-directional view of FIG. 5.
Figure 8:
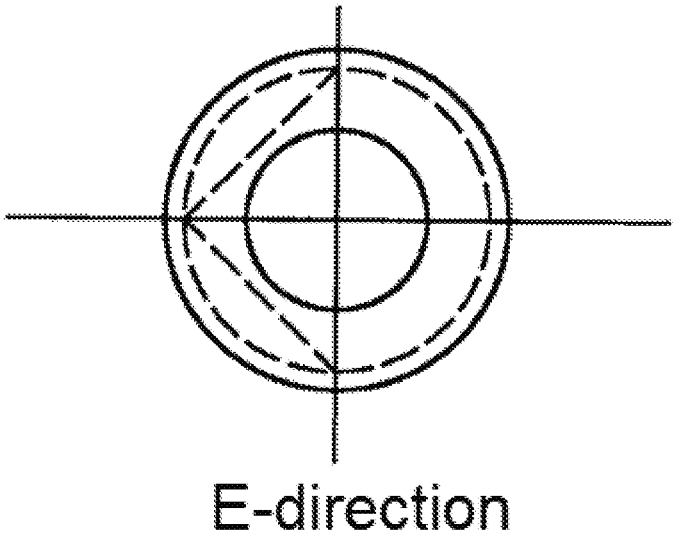
FIG. 8 is an E-directional view of FIG. 5.
Figure 9:
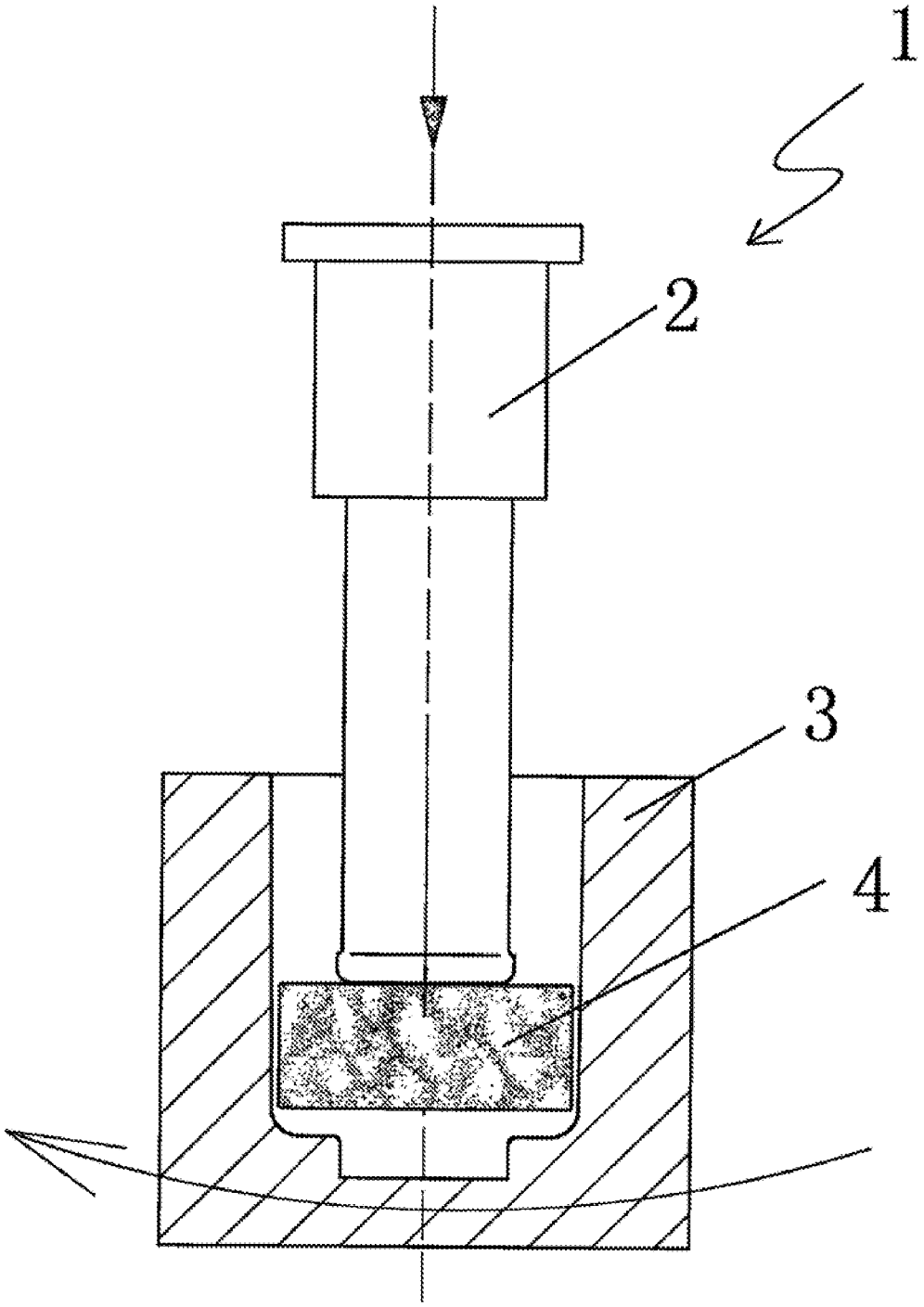
FIG. 9 is a schematic diagram of a method for forming an aluminum-magnesium-alloy cup-shaped workpiece by rotating extrusion according to the present disclosure.

As shown in FIGS. 1-9, a special-purpose die 1 for shaping an aluminum-magnesium alloy by rotating extrusion comprises a male die 2 and a female die 3, a trapezoidally-sectioned groove 23 is formed at an end portion 22 of a working area 21 of the male die to facilitate formation of a torque to the entire metal by using the metal in the trapezoidally-sectioned groove 23 during the forming process. In order to ensure the efficiency of heating the blank and the service life of the male die, an inner portion 24 of the male die 2 is hollow, with the hollow inner portion having sections of equal area, a circumferential wall 31 of a die cavity 30 of the female die is provided with six symmetrical axial grooves 32. At the same time of forward extrusion by the male die 2, by using the metal flowing into the axial grooves 32 during the extrusion process, the blank is rotated synchronously with the female die 3. In order to ensure the heating uniformity of the blank, a clamping part 34 of the female die is also provided therein with a cavity 33. In addition, in order to ensure the convenient welding of the thermocouple wires and prevent the thermocouple wires from falling off during the deformation process, a bottom 35 of the die cavity of the female die 3 has a part, where a blank is placed, with the part formed in a form of an insert 36, an inner hole 37 is formed in the middle of the insert 36 for allowing the thermocouple wires (not shown in the figures) to be welded, and the thermocouple wires, together with the insert 36, are then placed at the bottom 35 of the die cavity of the female die 3, which are convenient to operate.

The special-purpose die for shaping an aluminum-magnesium alloy by rotating extrusion of the present disclosure remarkably reduces the axial extrusion force such that the deformation of the formed workpiece is more uniform, and can be applied to a Gleeble 3500 (thermal simulation testing machine) torsion unit to realize the rotating extrusion forming technology, laying the foundation for physical simulation of the rotating technological parameters. In a torsion test, the circumferential movement of one end of a Gleeble 3500 test piece is constrained, and the other end thereof is driven to rotate by a hydraulic device under the servo control, the distribution of the temperature gradient within the entire gauge length of the torsion test piece in the axial direction is non-uniform, which will remarkably aggravate strain non-uniformity, and by the sensing of a temperature measuring element, the system carries out dynamic program control on the load and temperature of the torsion test piece. Thus, by reasonably designing the structural size of the special-purpose die for shaping an aluminum-magnesium alloy by rotating extrusion and by effectively controlling the temperature distribution to enable the heating of the inner test piece to tend to be uniform, highly-efficient and uniform heating of the test piece is realized, and dynamic test of the forming parameters of the torsion test is realized.

The present disclosure can also be used on a common extruding machine, if a male die electric heater (not shown in the figures) is placed in the hollow inner portion 24 of the male die 2 and a female die electric heater (not shown in the figures) is placed in the cavity 33 of the female die 3.

Figure 10:
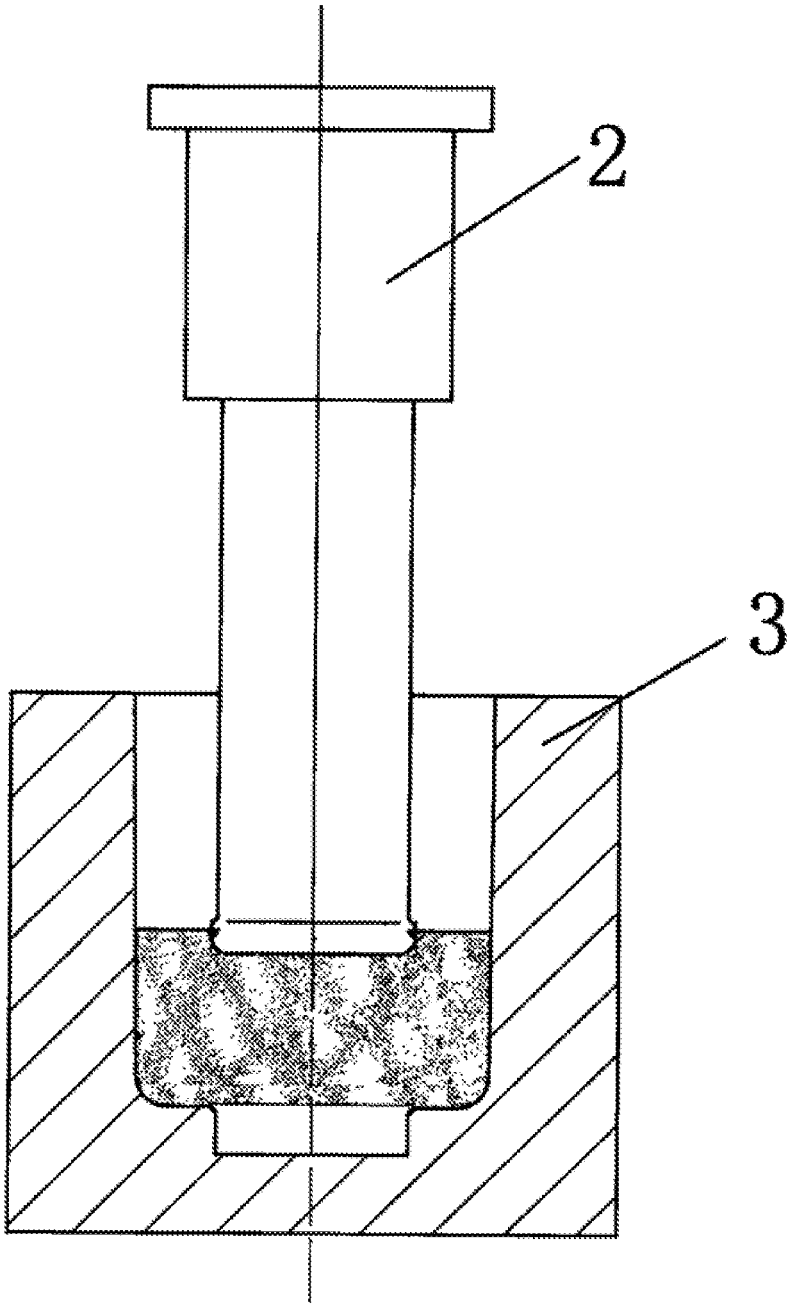
FIG. 10 is a schematic diagram of the method for forming an aluminum-magnesium-alloy cup-shaped workpiece by rotating extrusion according to the present disclosure.
Figure 11:
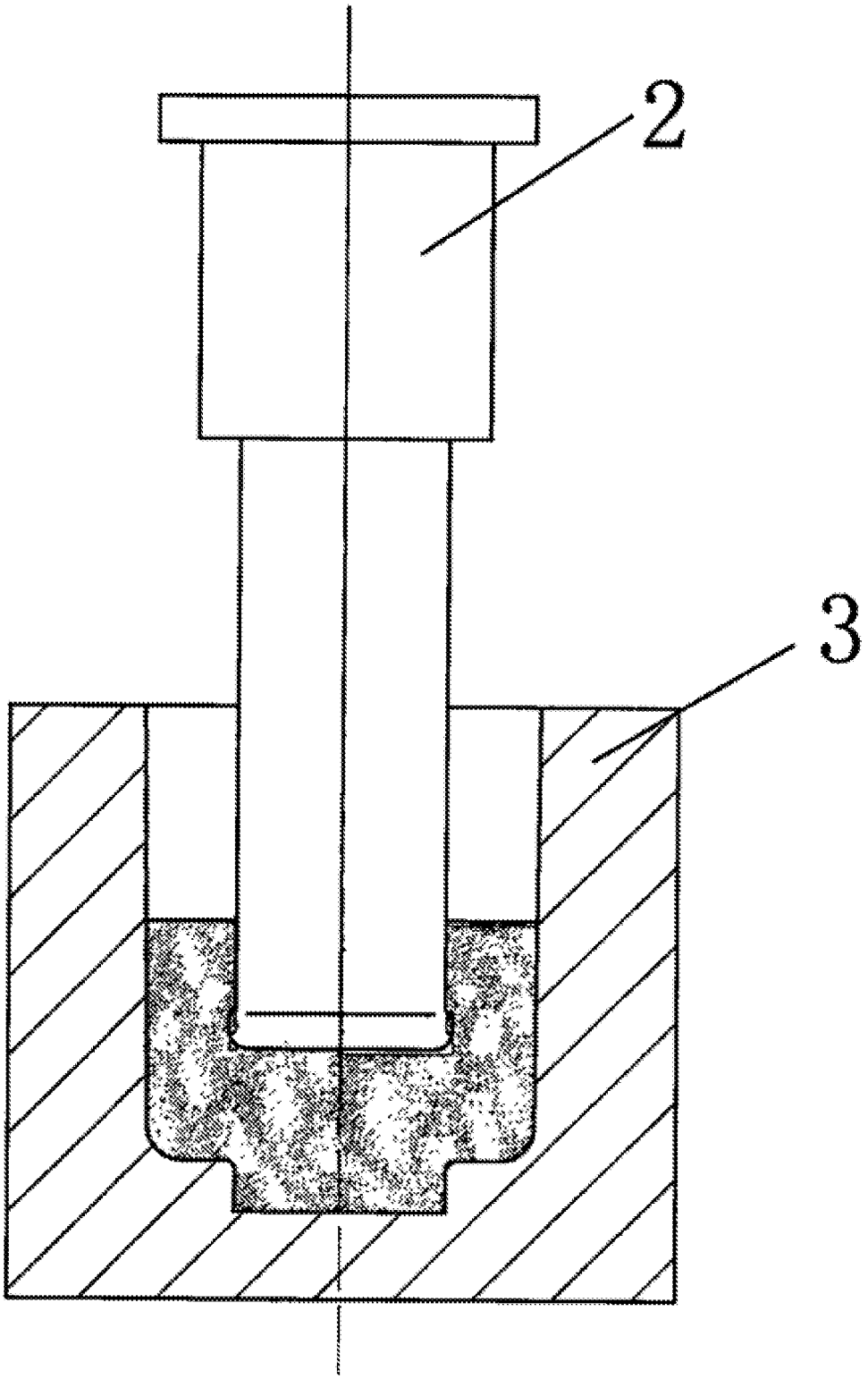
FIG. 11 is a schematic diagram of the method for forming an aluminum-magnesium-alloy cup-shaped workpiece by rotating extrusion according to the present disclosure.
Figure 12:
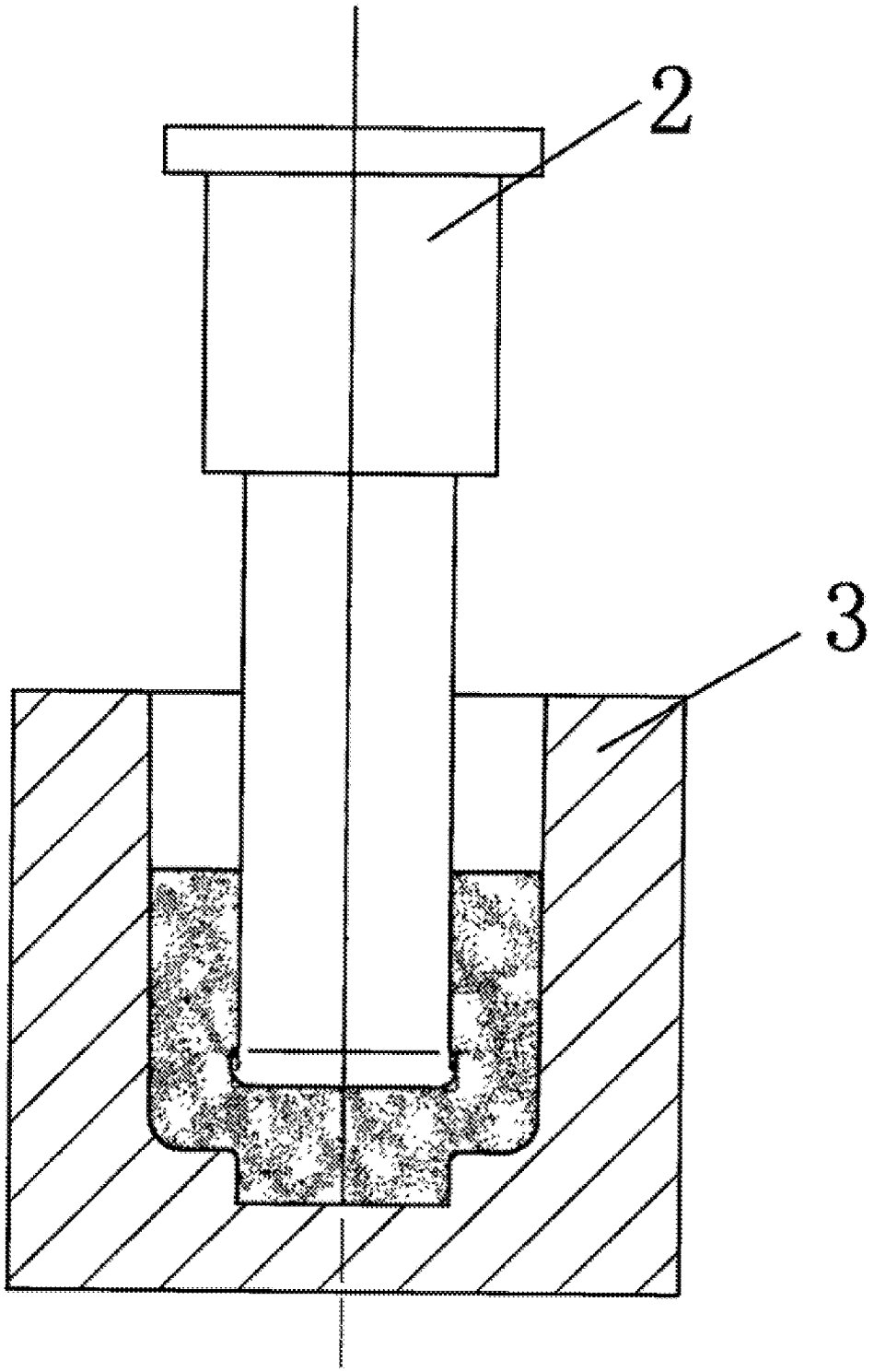
FIG. 12 is a schematic diagram of the method for forming an aluminum-magnesium-alloy cup-shaped workpiece by rotating extrusion according to the present disclosure.
Figure 13:
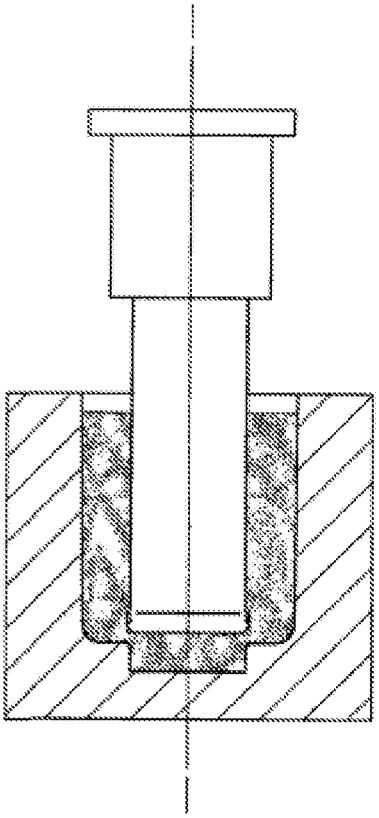
FIG. 13 is a schematic diagram of the method for forming an aluminum-magnesium-alloy cup-shaped workpiece by rotating extrusion according to the present disclosure.
Figure 14:
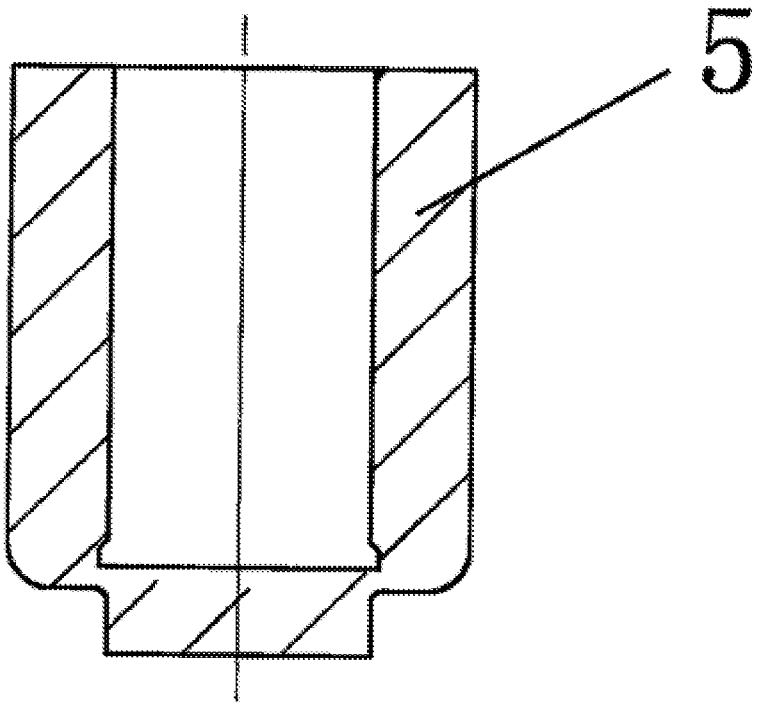
FIG. 14 is a sectional view of an aluminum-magnesium-alloy cup-shaped workpiece of the present disclosure.

As shown in FIGS. 3, 4, 7 and 9-14, the method for forming an aluminum-magnesium-alloy cup-shaped workpiece by using the special-purpose die 1 for shaping an aluminum-magnesium alloy by rotating extrusion of the present disclosure comprises the steps of:

(1) blanking: collecting a section of column-shaped blank 4;

(2) Rotating extrusion: placing the column-shaped blank 4 in the die cavity 30 of the female die, inserting the male die 2 into the die cavity 30 of the female die for forward extrusion and heating, and at the same time, rotating and heating the female die 3 to achieve the effect of extruding while rotating, wherein during the process of extrusion by the male die 2, an overall torque is formed using the column-shaped blank 4 in the trapezoidally-sectioned groove 23, and through the rotation of the female die 3, the axial extrusion force is greatly reduced, uniform flowing of the blank is promoted, the forming uniformity is improved, the axial and circumferential performance difference of the formed workpiece is greatly reduced, and the forming performance is improved; moreover, the friction force is significantly reduced, the material utilization rate is improved, and the severe plastic deformation process of extruding while rotating, achieved by making the metal blank flowing into the axial grooves 32 during the extrusion process synchronously rotate with the female die 3, helps to improve the mechanical property of the formed workpiece; and (3) demoulding: after the completion of the rotating extrusion, taking out a lightweight alloy cup-shaped piece 5 from the die cavity 30 of the female die.

Compared with the traditional forward extrusion, the method for shaping by rotating extrusion of the present disclosure has the following characteristics: (1) after torsion effect is applied to the female die, the material at the bottom corner can also deform and flow, the "dead zone" is remarkably diminished or even eliminated, and the material utilization rate is improved; (2) after a torque is applied to the female die, the stress state during the extrusion forming is changed, and the strong shear deformation will have significant impacts on the improvement of the microstructure; (3) in addition to flowing in the loading axial direction, the extruded metal further has a tendency to generate torsion deformation in the circumferential direction, which improves the plastic deformation degree of the metal to a great extent; and (4) under the condition of equivalent extrusion equipment, machining and manufacturing of irregular sections can be carried out, and under the condition of the same structure, the forming load and the equipment tonnage can be reduced, thereby achieving the object of "doing great work with small devices". According to the present disclosure, just by using these characteristics of rotating-die extrusion and using the tangential shear deformation, the normal pressure is reduced, the structural density is improved, the plastic deformation is intensified, and the structure morphology of the material is improved, enabling the deformation of the extruded workpiece to be more uniform, and moreover, the axial extrusion force is remarkably reduced such that the deformation of the formed piece is more uniform, which greatly improves the mechanical property of the formed workpiece. The present disclosure improves the material utilization rate, and can produce remarkable economic benefits if popularized in the forging industry.

The invention claimed is:

1. A special-purpose die for shaping an aluminum-magnesium alloy by rotating extrusion, comprising:

a male die; and a female die, wherein the male die comprises a working area of the male die and an inner portion of the male die, and the female die comprises a die cavity of the female die and a clamping part of the female die, and wherein a groove having a trapezoidal section is formed at an end portion of the working area of the male die, the inner portion of the male die is hollow, with the hollow inner portion having sections of equal area, a circumferential wall of the die cavity of the female die is provided with at least two symmetrical axial grooves, and a cavity is formed inside the clamping part of the female die.

2. The special-purpose die for shaping an aluminum-magnesium alloy by rotating extrusion according to claim 1, wherein an electric heater for the female die is placed in the cavity inside the clamping part of the female die.

3. The special-purpose die for shaping an aluminum-magnesium alloy by rotating extrusion according to claim 1, wherein the female die comprises thermocouple wires, an insert, and a bottom of the die cavity of the female die has a part, where a blank is placed, with the insert placed in the part, and an inner hole is formed in a middle of the insert for allowing the thermocouple wires to be welded, and the thermocouple wires, together with the insert, are then placed at the bottom of the die cavity of the female die.

4. The special-purpose die for shaping an aluminum-magnesium ahoy by rotating extrusion according to claim 1, wherein the circumferential wall of the die cavity of the female die is provided with six symmetrical axial grooves.

5. The special-purpose die for shaping an aluminum-magnesium alloy by rotating extrusion according to claim 1, wherein an electric heater for the male die is placed in the hollow inner portion of the male die.

* * * * *